US006053247A

United States Patent [19]

Wesson et al.

[11] Patent Number: 6,053,247

[45] Date of Patent: Apr. 25, 2000

[54] METHOD AND APPARATUS FOR SEVERING A TUBULAR

[75] Inventors: David S. Wesson, Waxahachie; Philip M. Snider, Houston, both of Tex.

[73] Assignee: Marathon Oil Company, Findlay, Ohio

[21] Appl. No.: 08/955,066

[22] Filed: Oct. 21, 1997

[51] Int. Cl.[7] ..... E21B 29/02

[52] U.S. Cl. ..... 166/297; 166/55.1; 166/63; 166/299

[58] Field of Search ..... 166/299, 297, 166/55, 55.1, 55.2, 63

[56] References Cited

U.S. PATENT DOCUMENTS 3,948,176 4/1976 Koomen ..... 166/299

5,513,570 5/1996 Mulcahy ..... 299/13

*Primary Examiner*—Eileen Dunn Lillis
*Assistant Examiner*—Chong S. Cho
*Attorney, Agent, or Firm*—Jack E. Ebel

[57] ABSTRACT

An apparatus and method for severing a tubular, such as a drill string, which is stuck within a subterranean well bore. A volume of liquid explosive is positioned within a housing and initially restrained against movement therein. The housing is lowered within the tubular and positioned at a location where the tubular is to be severed. The volume of liquid explosive is then moved into closer proximity to the tubular and detonated thereby severing the tubular. A portion of the tubular is then removed from the well bore.

19 Claims, 2 Drawing Sheets

METHOD AND APPARATUS FOR SEVERING A TUBULAR

BACKGROUND OF THE INVENTION

1. Field of the Invention

The present invention relates to method and apparatus for severing a tubular wherein the method and apparatus are operative to be used to severe tubulars of differing dimensions and/or a tubular having a constriction(s) along the length thereof, and more particularly, to such method and apparatus in which liquid explosive, which is contained within the apparatus and which is initially constrained against movement, is placed in close proximity to the tubular and detonated to sever the tubular.

2. DESCRIPTION OF RELATED ART

During drilling of a subterranean well, a drill string comprised of lengths of drill pipe connected by couplings may become stuck within the well bore being drilled. Due to the expense of such pipe, it is desirable to cut or severe the stuck drill string so that the maximum amount of drill pipe can be removed to the surface of the earth and salvaged for future operations. In workover operations in which tools are positioned downhole by means of tubing, the tubing and/or tool(s) may become stuck for a variety of reasons, such as mechanical failure of the tool(s) or build up of debris, and severing the tubular for removal from the well and salvage may be desirable. It may also be desirable when abandoning a well to severe the well casing above the position where such casing is cemented in a well for salvage.

Explosive jet pipe cutters which are lowered into a subterranean well by means of an electrical wireline are conventionally utilized to severe stuck pipe within the well. Such cutters are dimensioned to have an external diameter slightly less than the smallest diameter of the tubular to be severed. Thus, different diameter cutters are needed depending upon the exact diameter of the tubular to be severed. An electric detonator in the device is actuated by means of electrical current which is transmitted from a supply at the surface by means of the wireline. The detonator in turn detonates a high explosive, radially shaped charge which severs the pipe adjacent the explosion.

Conventional explosive severing tools are constructed of a relatively large quantity of explosive suspended within a tubular which is stuck in a well bore by means of a detonating cord. Upon detonation, the force of the explosion is radiated in all directions. As with conventional jet cutters, conventional explosive servering tools are sized to minimize the circumferential gap between the periphery of the tool and the tubular to be severed.

A significant drawback to the use of conventional explosive jet cutters or severing tools to severe stuck tubing or pipe within a well is that such cutters or tools are often sized sufficiently large, for example 2⅜ inch outer diameter, to be unable to pass through restrictions created by tubing or pipe which is damaged, i.e. bent or partially collapsed, but not stuck within a well. For this reason, conventional cutters are often unable to severe and remove a significant portion of tubing or pipe from a tubing string which is stuck in a well. Thus, a need exists for a method and apparatus capable of passing through restrictions within a tubing or pipe which is stuck within a well.

Accordingly, it is an object of the present invention to provide method and apparatus for severing a tubular which is stuck within a well wherein the apparatus is capable of passing through restrictions within the tubular so as to be positioned at a desired depth.

It is another object of the present invention to provide method and apparatus for severing a tubular which is stuck within a well wherein the apparatus is capable of being expanded so as to move liquid explosive into close proximity to the tubular upon being positioned at a desired depth.

It is a further object of the present invention to provide method and apparatus for severing a tubular wherein the transportation of explosives from a surface location to a subterranean location during operation of the apparatus and the attendant hazards associated therewith are obviated.

It is a still further object of the present invention to provide method and apparatus for severing a tubular wherein the apparatus is constructed and the method is carried out in a manner so as to enable one apparatus to be utilized in tubulars of all diameters which might be encountered within a well.

SUMMARY OF THE INVENTION

To achieve the foregoing and other objects, and in accordance with the purposes of the present invention, as embodied and broadly described herein, one characterization of the present invention is an apparatus for severing a tubular. The apparatus comprises a means for releasably securing a liquid explosive against movement with respect to a tubular within which the securing means is positioned, a means for moving the liquid explosive into closer proximity to the tubular and a means for detonating the liquid explosive so as to sever the tubular along the length thereof.

In another embodiment of the present invention an apparatus is provided for severing a tubular which comprises a housing sized to be received within and pass through the tubular and containing a volume of liquid explosive. The housing is adapted to be supported by a wireline. The apparatus also comprises a means for selectively moving the volume of liquid explosive into closer proximity to the tubular, a means for detonating the liquid explosive so as to sever the tubular into at least two portions, and a means for electrically connecting the detonating means to a power supply.

In yet another characterization of the present invention, a method for severing a tubular is provided which comprises releasably securing a liquid explosive within a tubular, moving the liquid explosive into closer proximity to the tubular, and detonating the liquid explosive so as to sever the tubular along the length thereof.

BRIEF DESCRIPTION OF THE DRAWINGS

The accompanying drawing, which is incorporated in and forms a part of the specification, illustrates the embodiments of the present invention and, together with the description, serves to explain the principles of the invention.

In the drawings.

DETAILED DESCRIPTION OF THE PREFERRED EMBODIMENTS

Figure 1A:
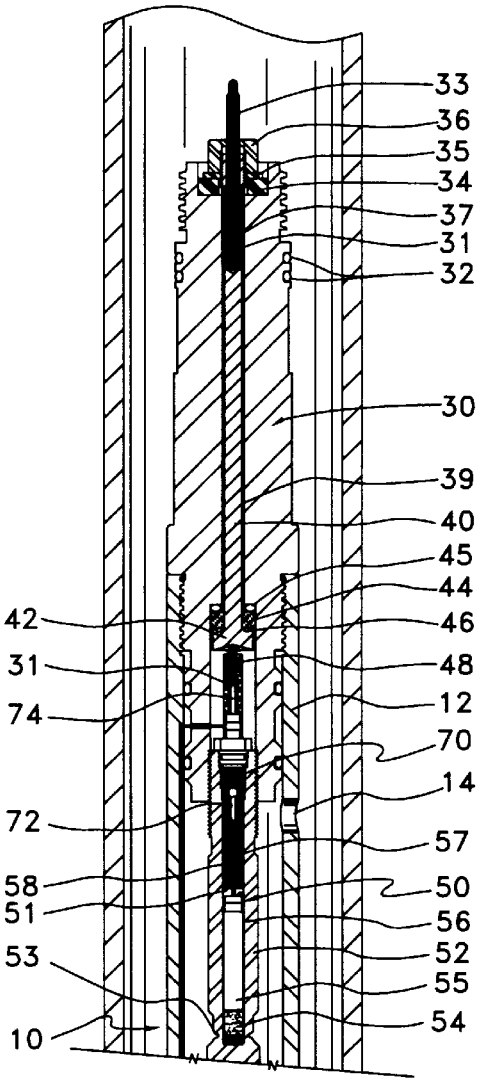
FIGS. 1A and 1B are partial cross sectional views which, as combined in the sequence noted, illustrate the detonating apparatus of the present invention as run into position within a subterranean well.
Figure 1B:
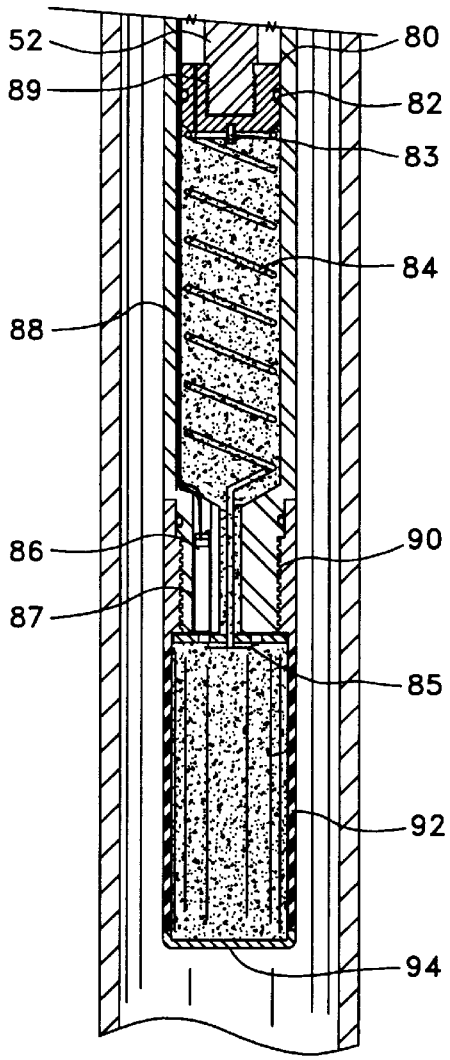

Referring to FIGS. 1A and 1B, the apparatus of the present invention is illustrated generally as 10 and as positioned within a tubular 8 to be severed. As utilized throughout this description, the term "tubular" includes, but is not limited to, drill pipe or tubing, drill collars, heavy weight drill pipe, well casing, and tubing. Apparatus 10 comprises a generally tubular housing 12 releasably secured at one end thereof to an electrical connection sub 30 by threaded engagement while the other end of housing 12 is releasably secured to an element 90 by threaded engagement therewith. Housing 12 is provided with at least one aperture or port 14 therethrough.

Electrical connection sub 30 is provided with a bore 31 through the body thereof. An insulating sleeve 39 is positioned within bore 31 to electrically insulate component parts which are positioned therein. A contact pin 33 is positioned within bore 31 and sleeve 39 and extends through insulating bushing 34 which is secured within sub 30 by any suitable means, for example snap ring 35. An insulating cap 36 is provided around the upper end of contact pin 33. A spring 37 is also positioned within bore 31 and sleeve 39 and contacts pin 33 at one end thereof and contact rod 40 at the other end thereof. Contact rod 40 is positioned within bore 31 and terminates in an expanded end portion 42 which has an larger diameter and which abuts contact spring 48. An insulating bushing 44 is provided around rod 40 adjacent end portion 42. O-rings 45 and 46 provide a fluid tight seal between rod 40 and the body of electrical connection sub 30. Insulating sleeve 39, bushings 34 and 44, and cap 36 are constructed of suitable electrical insulating material, for example phenolic resin.

A detonator assembly which is illustrated generally as 50 is releasably secured to electrical connection sub 30 by any suitable means, such as by screw threads. Detonator assembly 50 comprises a generally tubular housing 52 having a bore 51 formed therein into which an explosive load 54, for example lead azide, is positioned. The portion 53 of housing 52 which is adjacent to explosive load 54 is formed with a relatively thin side wall, for example 0.04–0.06 inches, so as to provide a weak point along housing 52 which can be severed or ruptured upon detonation of explosive load 54 as hereinafter described. A detonator 55 is also positioned within bore 51 adjacent to explosive load 54. A wire 56 is provided to ground the detonator 55 to housing 52. A positive lead wire 57 protrudes from one end of detonator 55 and is provided with an insulator 58 therearound.

An electrical connection assembly 70, for example that manufactured by Keystone Engineering Company under the trademark KEMLON, is releasably secured to housing 52 such that an electrical connector 72 extends into bore 51 of detonator assembly 50 and contacts positive lead wire 57 of detonator 55. An electrical contact pin 74 extends from the other end of electrical connection assembly 70 into bore 31 of electrical connection sub 30 and contacts spring 48.

The lower end of detonator assembly 50 is releasably secured to a substantially cylindrical plug 80 by any suitable means, such as by screw threads. Plug 80 is provided with an O-ring 82 about the external surface thereof to provide a fluid tight seal between plug 80 and housing 12. A spring 84 is secured to one face of plug 80 by any suitable means, for example by clasp 83, and extends through the lower portion of housing 12 and is secured to the lower end of housing 12 by means of plate 85. As thus assembled, spring 84 is in tension. The portion of housing 12 between plug 80 and plate 85 is provided with a suitable liquid explosive, for example an emulsion based explosive manufactured by Nelson Brothers under the trademark POWER-NEL. A sealed detonator 86 is positioned within a bore 87 formed in the lower end of housing 12 and is electrically connected to connection sub 30 by means of wire 88 which may be encased within a tube (not illustrated) constructed of a metal, for example stainless steel, which has sufficient strength to withstand the detonation of explosive load 54. Preferably, wire 88 is positioned within a groove or slot in the internal surface of housing 12 and encased by a metal shield which is positioned over the groove and wire 88 and secured to housing 12 by any suitable means, such as by welds. The shield is constructed of a metal, for example stainless steel, which has sufficient strength to withstand the detonation of explosive load 54. A suitable electrical connection assembly 89, for example that manufactured by Keystone Engineering Company under the trademark KEMLON, may be provided in plug 80 to assist in electrically connecting wire 88 therethrough.

An element 90 is threadably connected to housing 12 and has an end cap 94 and an expandable side wall 92 which can be formed of any suitable elastomeric material. Bladder 90 is initially filled with a volume of liquid explosive which is sufficient to substantially fill bladder 90 without expanding the side wall 92 thereof.

In operation, the contact pin 33 of the severing apparatus of the present invention is secured to a casing collar locator which in turn is suspended from the well head at the surface by wireline (not illustrated). The severing apparatus is positioned within a tubular which has become stuck within a subterranean well or well bore and is lowered within the tubular in the subterranean well or well bore until positioned where it is desired to severe the tubular. As assembled, the severing apparatus of the present invention is sized to be of a diameter, for example 1 11/16 inches uninflated, and a length, for example 4 feet inches, which permits the apparatus to readily pass through tubulars of conventional inner diameter, e.g. 1¾ inches or more, and through damage tubulars of restricted diameter that conventional severing devices cannot.

Figure 2A:
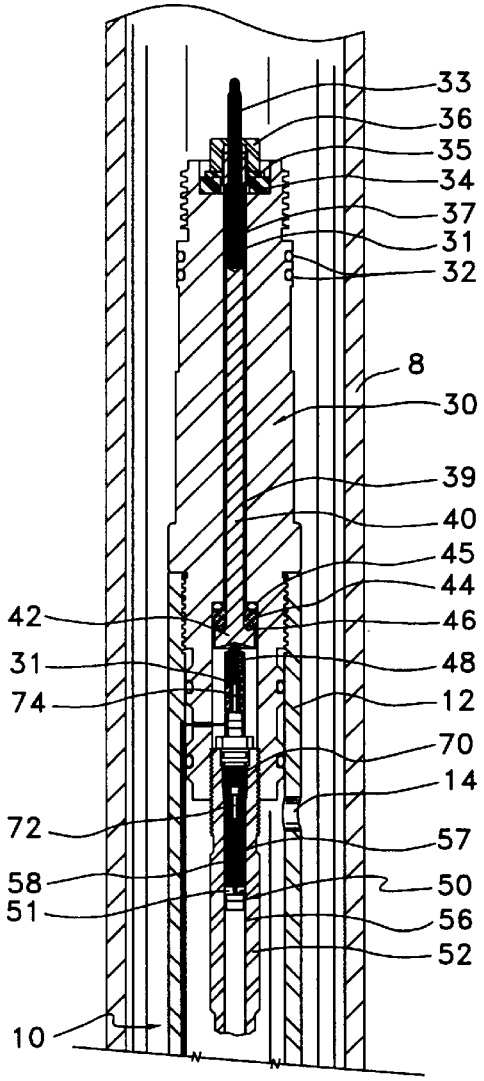
FIGS. 2A and 2B are partial cross sectional views which, as combined in the sequence noted, illustrate the detonating apparatus of the present invention as positioned within a subterranean well and expanded into contact with a tubular to be severed.
Figure 2B:
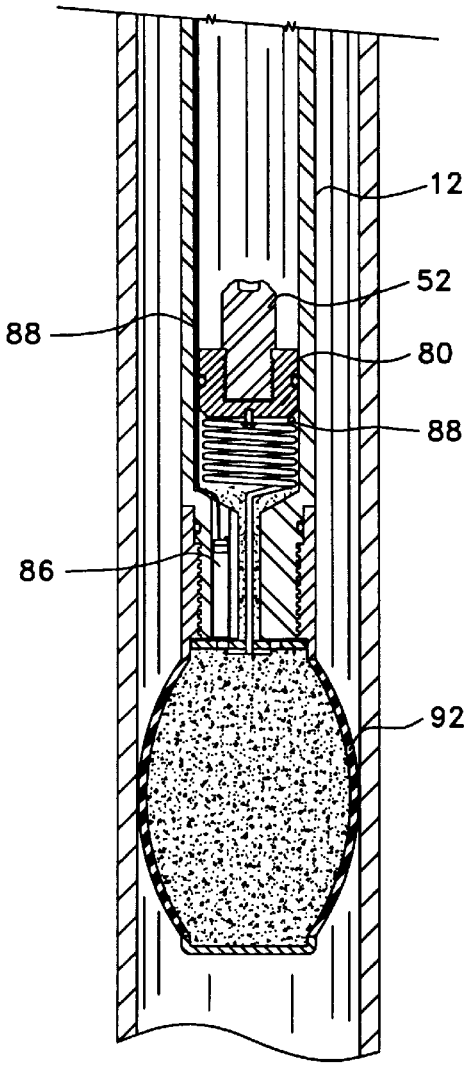

Once the severing apparatus of the present invention is positioned at a desired location within tubular 8, electrical current is applied to detonator 55 from an electric source at the surface, such as a power supply, via the wireline, casing collar locator, and electrical connection sub 30 thereby detonating explosive charge 54. As illustrated in FIGS. 2A and 2B, detonation of explosive charge 54 severs the thin walled portion 53 of housing 52 thereby permitting spring 84 to collapse. Well fluid entering port 14 also aids the collapse of spring 84. Spring 84 in turn pulls plug 80 through housing 12 thereby forcing liquid explosive initially contained in housing 12 into bladder 90 via a passageway through plate 85 such that the elastomeric sidewall 92 of bladder 90 is expanded outwardly into closer proximity to or contact with tubular 8. Application of electrical current of opposite polarity via the wireline, casing collar locator, electrical connection sub 30, and wire 88 to detonator 86 from the electric source at the surface detonates the liquid explosive contained within bladder 90 thereby severing the tubular at a location adjacent bladder 90. That portion of tubular 8 which is located above the point of severing can then be removed to the surface for salvage, reuse, and/or refurbishing.

The apparatus of the present invention is sized sufficiently small to permit the use thereof in conjunction with tubulars of varying diameters and to readily permit the transportation thereof to even the most difficult field locations. Further, since the apparatus of the present invention as assembled contains the entire volume of liquid explosive needed to sever a tubular, the need to transport explosives from a surface location to a subterranean location and the attendant hazards associated therewith are eliminated.

While the foregoing preferred embodiments of the invention have been described and shown, it is understood that the alternatives and modifications, such as those suggested and others, may be made thereto and fall within the scope of the invention.

We claim:

1. An apparatus for severing a tubular comprising:

means for releasably securing a liquid explosive against movement with respect to a tubular within which said securing means is positioned;

means for moving said liquid explosive into closer proximity to said tubular; and means for detonating said liquid explosive so as to sever said tubular along the length thereof.

2. An apparatus for severing a tubular comprising:

a housing sized to be received within and pass through the tubular and containing a volume of liquid explosive, said housing adapted to be supported by a wireline;

means for selectively moving said volume of liquid explosive into closer proximity to the tubular;

means for detonating said liquid explosive so as to sever the tubular into at least two portions; and means for electrically connecting said detonating means to a power supply.

3. The apparatus of claim 2 wherein said housing has at least one aperture therein.

4. The apparatus of claim 2 wherein said housing is rigid.

5. The apparatus of claim 2 wherein said tubular is a drill string which is stuck within a subterranean well bore.

6. The apparatus of claim 2 wherein said tubular is casing positioned and partially cemented within a subterranean well.

7. The apparatus of claim 2 wherein said tubular is a tubing string which is stuck within a subterranean well bore.

8. A method of severing a tubular comprising:

releasably securing a liquid explosive within a tubular;

moving said liquid explosive into closer proximity to said tubular; and detonating said liquid explosive so as to sever said tubular along the length thereof.

9. The method of claim 8 wherein said step of releasably securing said liquid explosive within said tubular comprises positioning said liquid explosive within a housing which is positioned within said tubular.

10. An apparatus for severing a tubular comprising:

a housing sized to be received within and pass through the tubular and containing a volume of liquid explosive, said housing adapted to be supported by a wireline;

means for selectively moving said volume of liquid explosive into closer proximity to the tubular, said selective moving means comprising a plug slidably positioned within said housing and a spring having a first end secured to said plug and a second end secured to said housing;

means for detonating said liquid explosive so as to sever the tubular into at least two portions; and means for electrically connecting said detonating means to a power supply.

11. The apparatus of claim 10 wherein said spring is in tension.

12. The apparatus of claim 10 wherein said plug is initially restrained against movement within said housing by means of a first detonator positioned within said housing.

13. The apparatus of claim 12 further comprising:

a bladder having an expandable side wall and being secured to said housing such that movement of said plug within said housing forces said liquid explosive into said bladder such that said sidewall of said bladder expands into closer proximity to the tubular.

14. The apparatus of claim 13 wherein said detonating means is a second detonator positioned adjacent said bladder for detonating said liquid explosive within said bladder.

15. The apparatus of claim 14 wherein said electrical connecting means is capable of withstanding detonation of said first detonator.

16. A method of severing a tubular which is positioned within a subterranean well bore and possess an internal diameter which is restricted at least once along the length thereof, said method comprising:

transporting a liquid explosive through said tubular from the surface through the restricted portion of said internal diameter;

moving said liquid explosive into closer proximity to said tubular; and detonating said liquid explosive so as to sever said tubular along the length thereof.

17. A method of severing a tubular comprising:

positioning a liquid explosive within a housing, said housing being positioned within a tubular;

forcing said liquid explosive into a bladder having an elastomeric sidewall and expanding the sidewall thereby moving said liquid explosive into closer proximity to said tubular; and detonating said liquid explosive so as to sever said tubular along the length thereof.

18. The method of claim 17 wherein said sidewall is expanded into contact with said tubular.

19. The method of claim 18 wherein said tubular is a drill string.

* * * * *